United States Patent [19]

DeHart et al.

[11] 4,147,518

[45] Apr. 3, 1979

[54] EXTRUSION APPARATUS FOR MAKING FIRE KINDLING DEVICE

[75] Inventors: Kenneth L. DeHart, Wyoming; Raymond C. Wing, Cascade Township, Kent County, both of Mich.

[73] Assignee: Pine Rest Christian Rehabilitation Services, Grand Rapids, Mich.

[21] Appl. No.: 773,835

[22] Filed: Mar. 2, 1977

[51] Int. Cl.[2] ..... C10L 5/22; C10L 11/08; B30B 11/00

[52] U.S. Cl. ..... 44/13; 44/2; 44/14

[58] Field of Search ..... 44/10 B, 10 H, 2, 13, 44/14, 24, 38, 41; 100/209

[56] References Cited

U.S. PATENT DOCUMENTS

| | | | |
|---|---|---|---|
| 764,072 | 7/1904 | Perry et al. | 44/10 B |
| 912,554 | 2/1909 | Foreman et al. | 44/14 |
| 2,107,054 | 2/1938 | Haymond | 44/41 |
| 2,218,897 | 10/1940 | Skutl | 44/10 B |
| 3,947,255 | 3/1976 | Hartman et al. | 44/10 H |
| 3,973,922 | 8/1976 | Williams | 44/13 |
| 4,046,518 | 9/1977 | Dalzell | 44/10 B |

*Primary Examiner*—Carl Dees

*Attorney, Agent, or Firm*—Price, Heneveld, Huizenga & Cooper

[57] ABSTRACT

A fire kindling device, extrusion method for making such devices, and extrusion apparatus for making same. The device is a composition of wood particles or chips of predetermined size and flammable paraffin wax in a ratio of about two parts wax to one part wood by weight. Application of controlled heat and pressure preferably by extrusion impregnates the wood with wax providing advantageous and efficient burning characteristics. The method includes blending quantities of the wood particles and molten wax, solidifying the mixture, extruding the solidified mixture under controlled heat and inserting a wick through the resultant product. The extrusion apparatus includes a cooling system for cooling the extrusion chamber to maintain the quality and consistency of the extruded product.

13 Claims, 10 Drawing Figures

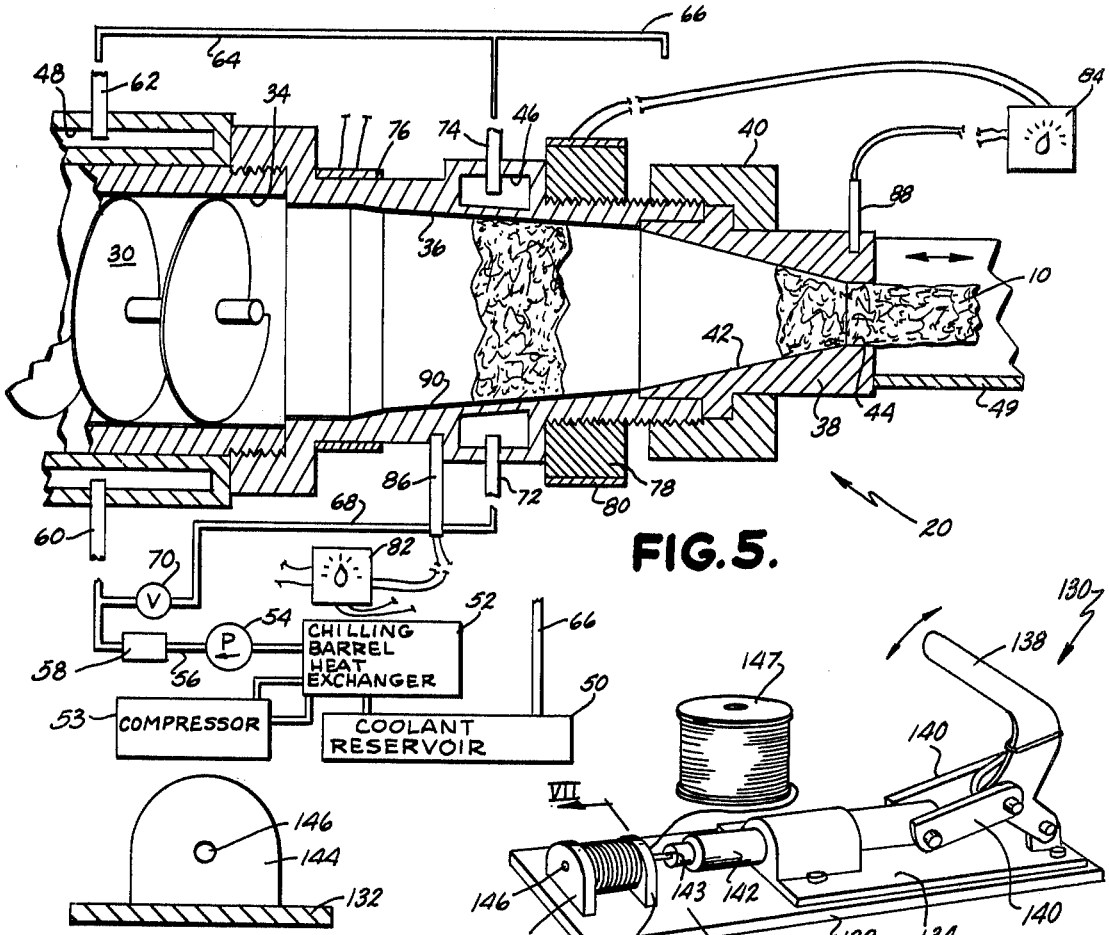
FIG. 5.
FIG. 7.
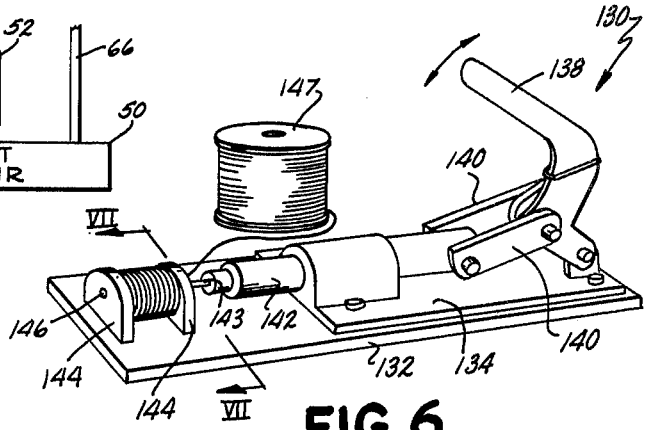
FIG. 6.
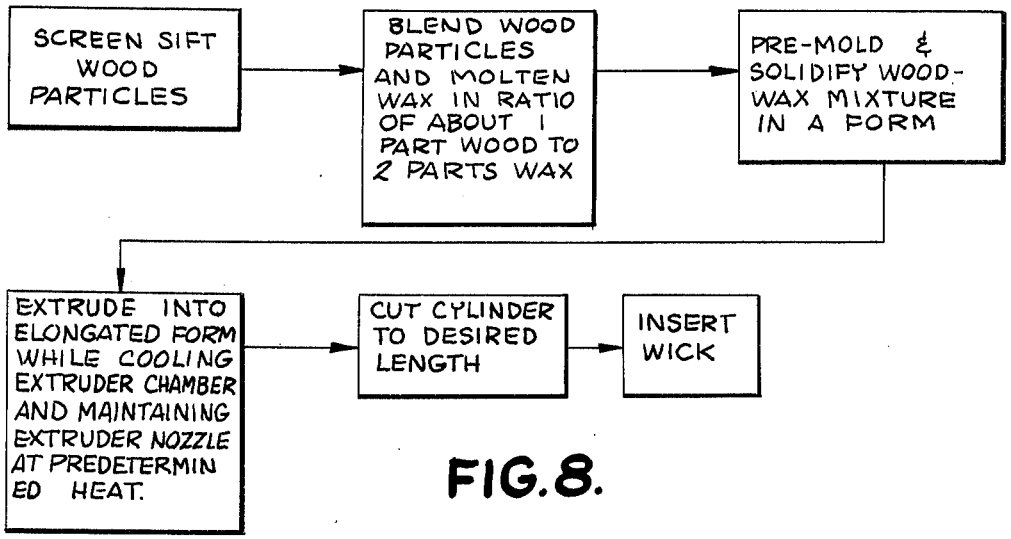
FIG. 8.

EXTRUSION APPARATUS FOR MAKING FIRE KINDLING DEVICE

BACKGROUND OF THE INVENTION

This invention relates to devices and compositions for starting or kindling fires and especially wood fires such as those in fireplaces or the like. In addition, the invention relates to a method and apparatus for extruding a composition of materials including wood particles and flammable wax into a cohesive mass suitable for burning as a kindling device.

Compositions for the ignition of fires have long been known. Previously known kindling compositions have utilized various petroleum products such as kerosene, tar and wax, and wood or charcoal to provide a mass which is burned initially to kindle a larger fire. The various ingredients were often crudely mixed and formed or molded into blocks or other shapes.

One such prior kindling unit is disclosed in U.S. Pat. No. 2,107,054, entitled "FUEL UNIT", issued Feb. 1, 1938, to L. M. Haymond. Tests have been conducted in accordance with the composition mixture therein which includes sawdust, wood shavings or shredded wood and paraffin wax in a ratio of two and one-half pounds finely divided wood to one pound paraffin wax. It was found that the mixture crumbled, was difficult to retain together in a unit, and therefore was difficult to burn or package. Manufacture of the composition units, especially on a reproduceable, mass basis was concluded to be very difficult. The test also established that the burning characteristics were little better than burning a quantity of finely divided wood alone.

The present invention was developed as an improvement over prior known fire kindling compositions. The device itself has been designed to include a combination of wood particles and flammable wax compressed, preferably by extrusion, into a cohesive mass which will burn evenly, at a sufficient temperature, and at a sufficiently rapid rate, but not too great a rate, to provide an effective starting device for larger fires. The composition of the device has been carefully determined to provide such effective burning characteristics as well as to be completely reproduceable on a consistent basis utilizing materials which are relatively inexpensive.

In addition, the invention encompasses a method and apparatus for producing the present fire kindling devices on a rapid, mass production basis while maintaining the consistency of the product for proper burning. An important aspect of the method is in the compaction of the composite materials, including wood chips or particles and flammable wax, preferably by extrusion under controlled heat. The method and apparatus allow the continuous production of the fire kindling devices each having a quality and consistency which provides the device with the ability to burn smoothly and evenly at a sufficient temperature and for a duration sufficient to kindle larger fires.

SUMMARY OF THE INVENTION

Accordingly, the present invention provides a fire kindling device comprising a composite member formed from a composition of wood and flammable wax with a flammable wick extending therethrough and beyond at least one surface thereof. The composite member includes a quantity of wood particles of predetermined maximum size and a predetermined quantity of flammable wax, preferably paraffin, in a ratio of about one part wood particles to two parts flammable wax, by weight. The wood particles are mixed with the flammable wax and thereafter compressed together with the controlled application of heat and pressure to form a compact mass which will burn uniformly and evenly when the wick is ignited. The compression of the mixed wood particles and flammable wax, preferably by extrusion, impregnates the wax within the wood particles and forms the mass into a cohesive unit which retains its shape and yet burns smoothly, evenly, at a proper temperature, and at a proper speed for efficient ignition of a larger fire.

In other aspects, the invention is a method for producing a fire kindling device including the steps of blending a quantity of wood particles with a quantity of flammable wax into a composition while the wax is in a molten state. The composition is cooled to form a solid mass and extruded into a kindling member with an extruder having an extrusion chamber and nozzle. During extrusion, the extrusion chamber is cooled to maintain both it and the extrusion nozzle at a predetermined heat. A flammable wick is inserted through the kindling member to enable ignition of the member.

The size of the wood particles is carefully controlled to obtain a proper amount of compression with the flammable wax during extrusion. In addition, the cooling of the extrusion means is carefully controlled so as to provide a kindling device of proper consistency without having the flammable wax become molten in the end product.

In yet another aspect, an apparatus is provided for extruding a composite mass such as the composition of flammable wax and wood particles including a rotatable extrusion member, means for rotating the extrusion member about a predetermined axis, and an extrusion chamber closely surrounding and coaxial with the extrusion member and extending beyond the end of the extrusion member. A nozzle is provided extending beyond and coaxial with the extrusion chamber as well as means for inserting material to be extruded in the extrusion chamber. Cooling means are provided for cooing the extrusion chamber to control the quality and consistency of the extruded mass.

In more specific details, the extrusion apparatus includes heating means for heating the extrusion chamber especially upon start-up of the extrusion process so that proper consistency of the product is obtained in a short period of time. Also, a feeding structure is included for feeding the composite mass into the extruder under a predetermined force to help maintain the product consistency and quality.

These and other objects, advantages, purposes and features of the invention will become more apparent from a study of the following description taken in conjunction with the drawings.

BRIEF DESCRIPTION OF THE DRAWINGS

FIG. 5 is a fragmentary, sectional view of the extrusion chamber, extrusion nozzle, and heating and cooling apparatus therefor;

FIG. 6 is a perspective view of the apparatus for inserting flammable wicks through the fire kindling devices;

FIG. 7 is a sectional view taken along line VII—VII of FIG. 6 of the wick-inserting device;

FIG. 8 is a flow diagram of the preferred method for producing the fire kindling devices of the present invention;

DESCRIPTION OF THE PREFERRED EMBODIMENTS

Fire Kindling Device

Figure 1:
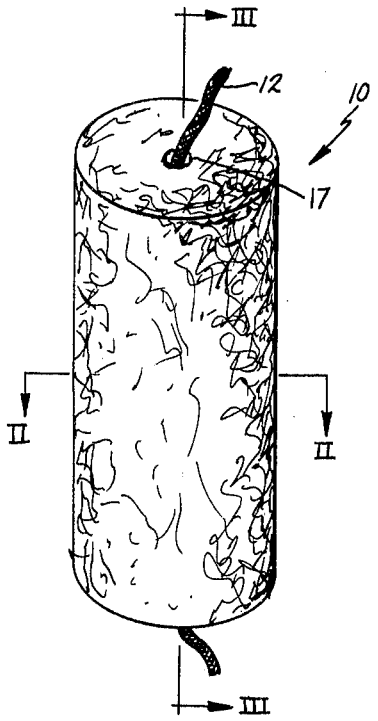
FIG. 1 is a perspective view of the fire kindling device of the present invention.

Referring now to the drawings in greater detail, FIG. 1 illustrates a generally cylindrical, elongated, fire kindling device 10 produced with the apparatus and method of the present invention. Device 10 is an extruded composite mass of wood particles or chips and flammable wax which is compressed or compacted into a cohesive mass preferably by the extrusion process.

The ingredients of the fire kindling member 10 are uniquely chosen and sized to be readily combinable under compression with a controlled amount of heat. The wood particles or chips are preferably obtained as waste material from milling operations, and preferably comprise quantities of particles having two different greatest dimension sizes. The first quantity includes particles or chips having a greatest dimension of approximately ¼ inch while a second quantity has a greatest dimension of approximately ⅝ inch across. Specific quantities of these size particles or chips, which are preferably sized by sifting through appropriately sized screen, and resulting sawdust from the sifting process, are mixed together and thereafter blended with a measured quantity of molten, flammable wax by weight preferably a paraffin wax having a melting point of approximately 124° to 125° F. As will be more fully explained below, the blended composition is transferred into elongated molds, cooled and allowed to solidify and thereafter extruded under controlled heat to produce the device shown in FIGS. 1-3.

A flammable wick 12, which preferably includes cotton or other flammable fabric threads or fibers woven into a cord, is forced through the center of the extruded mass with a needle or other insertion device such that the ends 13, 15 extend beyond the end surfaces 14, 16, respectively, of the kindling device. As described below, the wax at surfaces 14, 16 is pressed around the wick 12 to hold it in place. The wick is available at either end for ignition with a match to ignite and burn the kindling device to ignite a larger fire. The paraffin wax is preferably that obtained under the product number R-125-126 from the Kalamazoo Paraffin Company of Kalamazoo, Michigan. The type of wood used for the wood particles in the device is also important to the burning characteristics of the device in that soft, open-grained wood such as pine, especially that grown on sandy, loam soil is more easily impregnated with the flammable wax during compression or extrusion and actually burns easier and more quickly to produce better ignition of the larger fire. In addition, softer wood provides a more cohesive kindling device, that is, one which holds together better over longer periods. Further, the softer woods typically have a lighter color providing better aesthetic qualities for the manufactured kindling device. Although soft wood is preferred, close-grained, harder wood such as oak, maple or the like can also be used if sized as mentioned above.

An important aspect of the invention is the ratio of wood particles or chips to flammable wax included in the fire kindling devices 10. Generally, the ratio is approximately two parts flammable wax to one part wood particles including sawdust taken by weight. This ratio varies according to the type of wood used for the wood particles. That is, with softer, more open-grained woods, it is believed that a lesser quantity of wood particles should be used inasmuch as it is believed softer wood absorbs and is impregnated to a greater extent by wax. With harder, more closer grained wood, it is believed a slightly greater amount of wood should be used.

A specific ratio of wood particles or chips to flammable wax which has been found to produce a fire kindling device 10 of highly desirable smooth, even and sufficient duration and temperature burning characteristics is as follows: 12 ounces of small wood particles including resultant sawdust (⅝ inch across in greatest dimension), 16 ounces of large wood particles including resultant sawdust (¼ inch across in greatest dimension), 48 ounces of paraffin wax mixed with the quantities of wood particles and resultant sawdust in a molten state. The above example provides a specific ratio for the example of about twelve parts paraffin wax to seven parts wood particles. Further, the ratio of large size wood particles to small size wood particles in the example is about four to three by weight. In the above example, the type of wood used was an open-grained, white pine. It has been found, however, that depending on the type and hardness of wood used, the total quantity of wood particles in the ratio of the above example can vary by about plus or minus 8 ounces to the 48 ounces of paraffin wax. Thus, depending on the type of wood used, the ratio can vary between 5 to 9 parts wood particles to 12 parts flammable wax. The burning characteristics will remain relatively constant within this ratio range even if the type of wood is changed. Too much wood and too little wax in the mixture will prevent proper extrusion, proper cohesion of the mixture, increase difficulty in ignition and cause too rapid burning. Too much wax and too little wood will cause too long a burn duration and would amount to a conventional candle.

After the above mixture in the specific ratio mentioned is mixed together, solidified, extruded and provided with a wick, it has been found that the burning characteristics are excellent. For instance, a cylindrical kindling device having a length of 2½ inches and a diameter of approximately 1¾ inches was found to burn for approximately 23 minutes with a smooth, even flame of sufficient temperature which can efficiently ignite a larger fire in a fireplace or the like. Initial ignition took place in approximately 3 seconds at the one end surface of the cylinder at which the wick was lighted. Within approximately 2 minutes the entire surface of the device was ignited and burning with approximately a 3-inch high, blue-based, yellow flame. Substantially all the paraffin was burned in about 20 minutes. The device was found to ignite a dry log in approximately 4 minutes. Unexpectedly, the time for ignition of the device was tremendously faster for the compacted, compressed extruded device as opposed to the solidified, uncompressed or uncompacted, unwicked mixture of wood chips and paraffin wax. The uncompressed mixture was found to be impossible to pierce with a wick because of crumbling. Extrusion or compression thus enables such wicking. Also, the total burn time for the extruded form was about 24–25 percent longer than for the uncompressed, solidified mixture. It is believed that one of the principal reasons for such unexpectedly good burning characteristics is the impregnation of the paraffin wax or other flammable wax within the wood particles due to the compression or compaction under controlled heat, preferably by extrusion, as set forth hereinafter.

PREFERRED METHOD AND EXTRUSION APPARATUS

Figure 2:
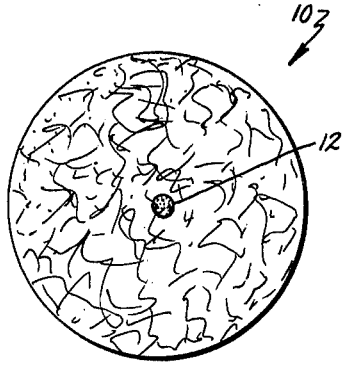
FIG. 2 is a sectional view taken along line II—II of FIG. 1 and transverse to the longitudinal axis of the fire kindling device.
Figure 3:
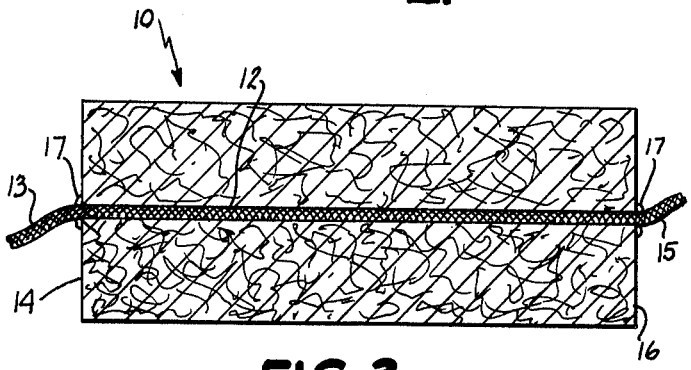
FIG. 3 is a sectional view taken along line III—III of FIG. 1 and parallel to the longitudinal axis of the fire kindling device.
Figure 4:
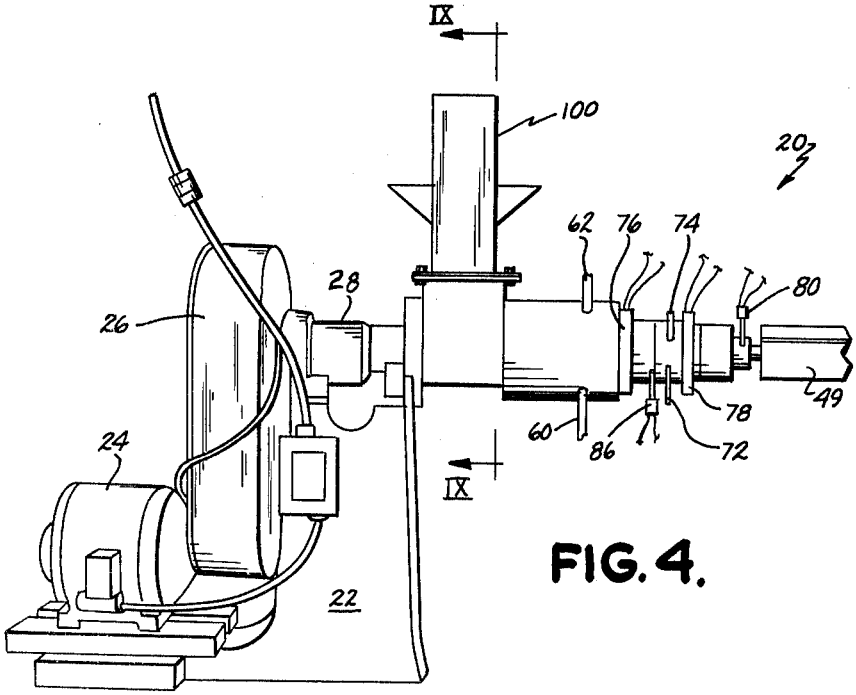
FIG. 4 is a perspective view of the extrusion apparatus of the present invention.

Referring now to FIG. 8, the preferred method for manufacturing the fire kindling devices illustrated in FIGS. 1–3 is shown. Wood particles or chips obtained from a milling operation or otherwise are first segregated into the desired sizes by sifting through screen having openings therein of appropriate sizes. In order to obtain the ¼ and ⅜ inch particles described above, screens having openings therein of approximately 5/16 and ¼ to 3/16 inches are employed. The original quantity of wood chips or particles is first shifted with the smaller sized screen and thereafter the remaining particles are sifted through the larger sized screen to obtain two discreet quantities of different sized particles as well as the resultant sawdust.

The sifted wood particles or chips may thereafter be dried using a gas drying apparatus or the like although the drying step is not wholly necessary and does add expense to the process. If dried, the wood particles tend to absorb and be impregnated with a greater amount of wax during the manufacturing process thereby enhancing the burning characteristics of the resultant kindling device.

After screen sifting the wood chips or particles, a specified quantity of each of the sizes of particles including sawdust is mixed with a quantity of molten wax and blended into a thorough mixture using a spatula or other mixing device. As above, the ratio of wax to wood particles is generally 2 to 1. In the specific example cited above, the ratios of wax to wood particles was approximately 12 to 7 with the wood particles being further subdivided into a quantity of larger particles to a quantity of smaller particles in a ratio of approximately 4 to 3 including resultant sawdust.

After the above blending, the molten wax wood chip composition is transferred and pressed into elongated molds and allowed to cool and solidify to form elongated blocks of the blended materials. If desired, the solidification process can be speeded by refrigeration of the molds, preferably at a temperature of between 0° to 32° F. Thereafter, the solidified blocks are removed from their molds and inserted into an extrusion apparatus of the type described hereinafter.

As shown in FIGS. 4, 5, 9 and 10, extrusion apparatus 20 includes a base 22 on which is mounted an electric motor 24. An extruder barrel 28 is supported by the upper portion of the base 22 and includes therewithin a rotatable extrusion member, preferably a screw-type auger 30 suitably supported on bearings for rotation, which extends through the barrel from a set of housed gears 26 into the extrusion chamber. The electric motor 24 drives and rotates the screw-type auger via gears 26. A feeding device 100 is mounted atop the barrel over an entrance aperture 32 (FIG. 9) immediately above the auger extrusion member 30.

The right-hand or nozzle end of the extrusion apparatus 20 is best seen in FIG. 5. Extrusion chamber 34 closely surrounds extrusion member 30 and extends coaxially beyond the end of rotatable extrusion member 30 in area 36 which tapers convergingly toward a brass extruder nozzle 38. A collar on nozzle 38 abuts the end of extrusion chamber area 36 and is retained thereon by a ring-like collar 40. Nozzle 38 includes an extrusion passageway ending in an aperture opening to the exterior of the extruder. The extrusion passageway includes a conical, tapering converging passageway section 42 through which the extruded material passes from extrusion chamber area 36 to the right in FIG. 5 into a cylindrical extrusion passageway section 44 which ends in the opening to the exterior. The entire extended extrusion chamber 36 is threaded on the end of extrusion chamber 34 and includes a hollow, liquid-tight, cooling jacket 46 extending circumferentially around its mid section. A second, larger, hollow, liquid-tight, cooling jacket 48 extends about the circumference of the extrusion chamber 34 in which auger-type extrusion member 30 ends as shown in FIG. 5. A tray, tube or other support 49 (FIGS. 4 and 5) is provided adjacent the opening of the extruder nozzle 38 to support the extruded fire kindling material as it exits the extruder.

Cooling jackets 46, 48 are provided to precisely and accurately control the temperature within the extrusion chamber 34, 36 as well as the extrusion nozzle 38 during the extrusion process. A cooling system is provided for pumping a refrigerant or coolant, preferably an antifreeze solution of ethylene-glycol and water or pure ethylene-glycol to cooling jackets 46, 48 at a temperature of approximately 32° F.±5° F. (27° F. to 37° F.) so that the temperature of the extruded material within the extruder is maintained below the melting point of the flammable wax which is about 124° F. to 125° F. A pump 54 pumps liquid coolant from a reservoir 50 through a conventionally known chilling barrel or heat exchanger 52 and on through a conduit or coolant line 56 in which a thermometer 58 is included for monitoring the coolant temperature. Compressed freon is circulated through barrel 52 from a compressor 53 to cool the refrigerant. Normally, the coolant is inserted through an insertion conduit 60 into the main cooling jacket 48 which primarily cools the extrusion chamber 34 in the area of the end of screw-type auger 30. The coolant is circulated within the cooling jacket, exits through a conduit 62, and passes through coolant lines 64, 66 for return to the reservoir 50. For additional cooling, a conduit 68 leads from coolant line 56 through a conventional valve 70 to an insertion conduit 72 in cooling jacket 46. Valve 70 is opened to provide additional cooling of the extended extrusion chamber area 36. After circulation within the cooling jacket 46, the coolant exits through conduit 74 merging with line 66 for return to the reservoir 50. During operation of the extruder, the coolant circulated at 32°±5° F. maintains the extrusion apparatus in the extrusion chamber area 34, 36 at a temperature of approximately 115° F. Such cooling also maintains the extruder nozzle at approximately 115° F. which is slightly below the paraffin wax melting temperature of 124° to 125° F. Extrusion apparatus 20 except for chamber 36, nozzle 38, collar 44 and pressure feed apparatus 100 is a Benjamin Eastwood Houghin Machine, Model G179, obtained from Newman Tallow and Soap Machine Co., Inc., 3601 S. Iron St, Chicago, Illinois.

Upon initial start-up of the extrusion apparatus, when the extruder is not at its operating temperature, additional heating is provided around extrusion chamber 36 to build the extrusion apparatus temperature to its normal operating temperature. Heating units or jackets 76, 80, comprising resistance-type electrical heating bands formed from a magnesium alloy, are secured about the extrusion chamber downstream from extrusion member 30 to provide initial heat. A first heating band 76 is secured about the circumference of the chamber 36 near the end of chamber 34 while a second band 80 is secured about the circumference of a brass collar 78 threaded over the end of chamber 36 and abutting the side of the housing forming the cooling jacket 46. Bands 76, 80 are connected electrically to control units 82, 84, respectively, which in turn are connected to temperature sensors 86, 88, respectively, and a suitable electrical source. Units 82, 84 are the series control units from Fenwal, Inc., a Division of Walter Kidde & Co., Ashland, Massachusetts. Each of the temperature sensors is a sensing unit which senses the temperature at its tip. A preferred sensor is that sold under the trade name "THERMISTER" also by Fenwal, Inc. Sensor 86 is inserted in a bore on the extrusion member side of the housing forming cooling jacket 46 and is also connected electrically to control unit 82. Temperature sensor 88 is inserted in a bore immediately adjacent the nozzle opening in nozzle 38 and is connected electrically to control unit 84. Each of the control units 82, 84 is a potentiometer utilized to set the temperature at which the heating bands 76, 80 will be shut off, connected to a solid state relay circuit which actually shuts off the heating bands at the predetermined temperature sensed by temperature sensors 86, 88. Thus, upon start-up of the extruding apparatus, control units 82, 84 are set for a predetermined temperature, preferably 115° F., and the heating bands are operated to apply heat to the extrusion chamber to bring the extrusion apparatus to its approximate operating temperature. During this time, the coolant is being circulated through cooling jackets 46, 48 while the extrusion apparatus comes up to full operating temperature necessary to adequately produce the composite material for a fire kindling device of the quality and consistency necessary for proper burning.

Figure 9:
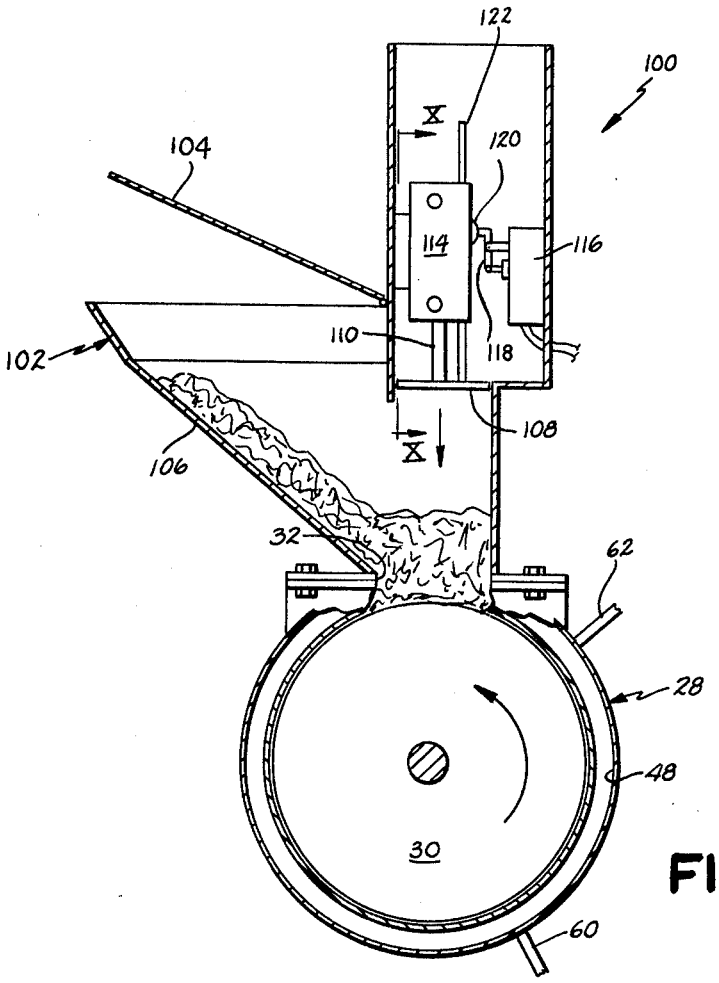
FIG. 9 is a sectional view taken along line IX—IX of FIG. 4 of the extrusion chamber and extrusion feeding device of the present invention.
Figure 10:
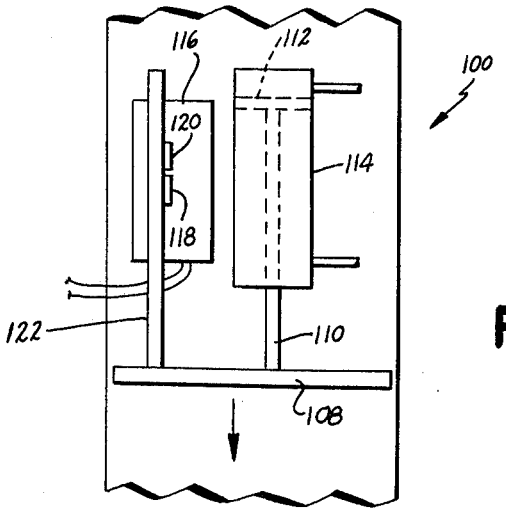
FIG. 10 is a fragmentary, sectional view of the extrusion feeding apparatus taken along line X—X of FIG. 9.

As is best seen in FIGS. 9 and 10, the feeding apparatus 100 includes a hopper 102 and a hinged cover 104 into which the solidified, blended mixture of wood chips and paraffin wax formed into elongated blocks is inserted. Feeding of the solidified, blended mixture under pressure minimimizes back-up of the mixture in the extruder and prevents build-up of the mixture and obstruction within the extruding chamber or area. The walls 106 of the hopper converge and lead to an entrance aperture 32 at the top of the extrusion chamber directly over screw type auger extrusion member 30 (FIG. 9). Immediately above aperture 32 and aligned therewith at one side of hopper 102 is a pressure feeding structure for forcing the solidified composition matter into the extrusion chamber.

As shown in FIGS. 9 and 10, the pressurized feeding structure includes a nylon pressure plate 108 fixedly secured to the piston shaft 110 of a piston 112 within a conventional pneumatic fluid cylinder 114. Cylinder 114 operates via compressed air at approximately 100 psi to drive pressure plate 108 downwardly into aperture 32 to force the composite material adjacent the rear wall of the hopper under a predetermined pressure, perferably approximately 50 psi, into the extrusion chamber 34. In order to provide a lower limit for the extension or downward movement of pressure plate 108, a limiting control device is provided adjacent the pneumatic cylinder. The control device includes a limit switch 116 operated by a pivotable contact member 118 having a roller 120 at its end which contacts a vertically extending rod fixedly secured to the upper surface of pressure plate 108. Rod 122 is of sufficient length to enable the plate to be moved downwardly to aperture 32 immediately above extrusion member 30. At that point, pivot member 118 and roller 120 disengage from rod 122 closing the limit switch 116 which in turn activates a solenoid (not shown) which in turn control a pilot valve controlling air inserted in the bottom of air cylinder 114. The pressure plate 108 is, therefore, reciprocated vertically and returned to its beginning position above aperture 32 such that it is positioned to force an additional quantity of the composite mass into the extruder.

Accordingly, the blended composite of wood chips of a predetermined size and paraffin wax in the specific ratio mentioned above is forced into the extruder under pressure which enhances the cohesiveness and quality of the extruded material exiting the extruder. For best results, it has been found that the composite mass should be extruded with extruder 20 twice so as to properly impregnate the wax in the wood particles and compress the material into a cohesive mass. The controlled heat during extrusion allows the wax to be impregnated in the wood particles and yet not be molten at the end of the process so that a cohesive, unified mass is obtained at the extruder nozzle.

After extrusion, the continuous, elongated, cylinder of extruded fire kindling material is severed by sawing or cutting into shorter lengths, preferably approximately 3 inches in length, and a flammable wick is inserted along the central axis of each cylinder kindling device 10.

As shown in FIGS. 6 and 7, one device 130 is shown which may be used to insert the flammable wick. Device 130 includes a plate base 132 including a bracket 134 having a hollow, tubular member 136 formed or secured thereon. A generally L-shaped handle 138 is pivotally secured or mounted at the end of bracket 134 on upstanding supports and is pivotally connected via links 140 to a reciprocable cylinder 142 mounted within tubular member 136. Cylinder 142 includes an elongated needle 143, having a length greater than the length of a fire kindling device formed from the composite wood chips and paraffin wax. A fire kindling member is fitted between a pair of spaced retaining walls 144 adjacent the end of needle 143. Retaining walls 144 include aligned apertures 146 through which needle 143 is projected by forcing handle 138 to the left in FIG. 6 which reciprocates cylinder 142, and thus the needle, in that direction. Prior to movement of the handle, wick material, which may be utilized as it is unrolled from a bulk supply 147, is threaded over a notch in the needle. Movement of the handle forces the needle and wick entirely through the cylinder and the aligned apertures 146. Thereafter, the wick is removed from the needle, the free end of the wick is held, and the needle withdrawn. The inserted wick is thereafter severed from the bulk roll.

In order to retain the wick within the fire kindling device, the end surfaces 14, 16 of the kindling device cylinder 10 are pressed around the wick as shown at 17 in FIGS. 1 and 3.

Accordingly, the present invention provides a fire kindling device which burns smoothly and evenly, at a sufficient temperature and for a sufficient duration to efficiently kindle a larger fire in a fireplace or the like. The coherent mass produced by the extrusion of the wood particles or chips and flammable wax under pressure or compression and controlled heat impregnates the wood particles with wax and retains the composite materials together as a unit to enable proper burning. In addition, the composition of the fire kindling device is consistently reproduceable with the defined method and apparatus which utilizes controlled heat in an extrusion process.

While several forms of the invention have been shown and described, other forms will now be apparent to those skilled in the art. Therefore, it will be understood that the embodiments shown in the drawings and described above are merely for illustrative purposes and are not intended to limit the scope of the invention which is defined by the claims which follow.

The embodiments of the invention in which an exclusive property or privilege is claimed are defined as follows:

1. Extrusion apparatus for extruding a composite mass such as a composition of flammable wax and wood chips to form fire kindling material comprising a rotatable extrusion member; means for rotating said extrusion member about a predetermined axis; an extrusion chamber closely surrounding and coaxial with said extrusion member and extending beyond the end of said extrusion member, and a nozzle extending beyond and coaxial with said extrusion chamber; means for inserting a mixture of wood particles and wax with said wax in solid form under a predetermined pressure in said extrusion chamber; and a coolant system for cooling said extrusion chamber to control the quality and consistency of the extruded mass, said system including at least one hollow, liquid-tight jacket surrounding said extrusion chamber and cooling means for circulating a liquid coolant through said jacket at a predetermined temperature.

2. The extrusion apparatus of claim 1 including heating means for heating said extrusion chamber.

3. The extrusion apparatus of claim 2 including control means for controlling the operation of said heating means.

4. The extrusion apparatus of claim 3 wherein said control means include temperature sensing means for sensing the temperature of said extrusion chamber at at least one position and potentiometer means for operating said heating means until said extrusion chamber reaches a predetermined temperature.

5. The extrusion apparatus of claim 2 wherein said heating means include a resistance heating band secured about the circumference of said extrusion chamber.

6. The extrusion apparatus of claim 2 wherein said heating means include a pair of resistance heating bands secured about the circumference of said extrusion chamber at spaced positions, said spaced positions being located on said extrusion chamber downstream of said rotatable extrusion member.

7. The extrusion apparatus of claim 1 wherein said extrusion nozzle includes an extrusion passageway having a first conical section receiving said composite mass from said extrusion chamber and converging toward a second cylindrical section coaxial with said first section and opening to the exterior of said extrusion apparatus.

8. The extrusion apparatus of claim 1 wherein said rotatable extrusion member is a screw-type auger.

9. The extrusion apparatus of claim 1 including a second liquid-tight jacket surrounding another portion of said extrusion chamber at a position spaced from said one jacket; said cooling means including means for pumping and circulating a liquid coolant at a predetermined temperature within said two cooling jackets.

10. The extrusion apparatus of claim 1 including heating means for heating said extrusion chamber, said heating means including a pair of resistance heating bands secured about said extrusion chamber at spaced positions, said spaced positions being located on said extrusion chamber downstream of said rotatable extrusion member; control means for controlling the operation of said heating means, said control means including temperature sensing means for sensing the temperature of said extrusion chamber at at least one position and potentiometer means for operating said heating means until said extrusion chamber reaches a predetermined temperature.

11. The extrusion apparatus of claim 1 wherein said means for inserting said mixture in said extrusion chamber include a hopper mounted over a portion of said extrusion chamber for receiving said mixture in solid form to be extruded and means on said hopper for forcing said mixture from said hopper into said extrusion chamber under a predetermined pressure.

12. The extrusion apparatus of claim 11 wherein said hopper includes walls converging toward an entrance to said extrusion chamber; said feeding means including a plate, fluid cylinder means connected to said plate for moving said plate toward and away from said extrusion chamber entrance, and feed control means for controlling the operation of said fluid cylinder means to limit the movement of said plate toward said entrance.

13. The extrusion apparatus of claim 12 wherein said feed control means include a limit switch means connected to said fluid cylinder means for starting and stopping operation of said fluid cylinder, said limit switch means having a contact member for operating said limit switch means; and means on said plate for engaging and disengaging said contact member as said plate is moved to control operation of said limit switch means and thus said fluid cylinder means and plate.

* * * * *

UNITED STATES PATENT AND TRADEMARK OFFICE

CERTIFICATE OF CORRECTION

PATENT NO. : 4,147,518

DATED : April 3, 1979

INVENTOR(S) : De Hart et al.

It is certified that error appears in the above-identified patent and that said Letters Patent are hereby corrected as shown below:

Column 2, Line 41
"cooing" should be --cooling--

Column 3, Line 37
"5/8" should be --1/8--

Column 4, Line 26
"5/8" should be --1/8--

Column 5, Line 26
"5/8" should be --1/8--

Column 5, Line 29
"shifted" should be --sifted--

Column 8, Line 17
"control" should be --controls--

Signed and Sealed this

*Twenty-fourth* Day of *July 1979*

[SEAL]

*Attest:*

*Attesting Officer*

LUTRELLE F. PARKER

*Acting Commissioner of Patents and Trademarks*